United States Patent [19]

Hugo

[11] Patent Number: 4,835,810

[45] Date of Patent: Jun. 6, 1989

[54] WHEELED POOL VACUUM HEAD WITH VACUUM ENHANCING SEAL

[75] Inventor: Donald G. Hugo, Palm Springs, Calif.

[73] Assignee: Rainbow Lifegard Products, Inc., El Monte, Calif.

[21] Appl. No.: 141,206

[22] Filed: Jan. 6, 1988

[51] Int. Cl.[4] ..... E04H 3/20

[52] U.S. Cl. ..... 15/1.7

[58] Field of Search ..... 15/1.7, 415 R, 418; 210/169

[56] References Cited

U.S. PATENT DOCUMENTS

| | | | |
|---|---|---|---|
| 3,085,267 | 4/1963 | Jacuzzi | 15/1.7 |
| 3,273,188 | 9/1966 | Levack | 15/1.7 |
| 3,805,309 | 4/1974 | Levack | 15/1.7 |
| 3,868,739 | 3/1975 | Hargrave | 15/1.7 |

*Primary Examiner*—Edward L. Roberts

*Attorney, Agent, or Firm*—Christie, Parker & Hale

[57] ABSTRACT

A vacuum cleaner head, for use in cleaning submerged surfaces of swimming pools, has a body the lower surface of which is supported a selected distance above a support surface, such as a pool floor, by wheels carried by the body. Resilient seal means depend from the body along front and rear edges thereof into close cooperation with the support surface to define essentially sealed side walls of a chamber which has the support surface as its bottom and the body lower surface as its top. The chamber is open at its ends which are generally at the ends of the head body. A water suction port is provided through the body from the chamber between the chamber ends; the port is connectible to a water suction hose. When the cleaner head is in use, water flows into the chamber essentially only through the open ends of the chamber and then to the suction port. The cleaning effectiveness of such water flow on the pool surfaces is of increased uniformity so all portions of the pool surface traversed by the chamber, as the head is moved on the pool surface, are cleaned substantially equally well.

5 Claims, 4 Drawing Sheets

Fig. 2
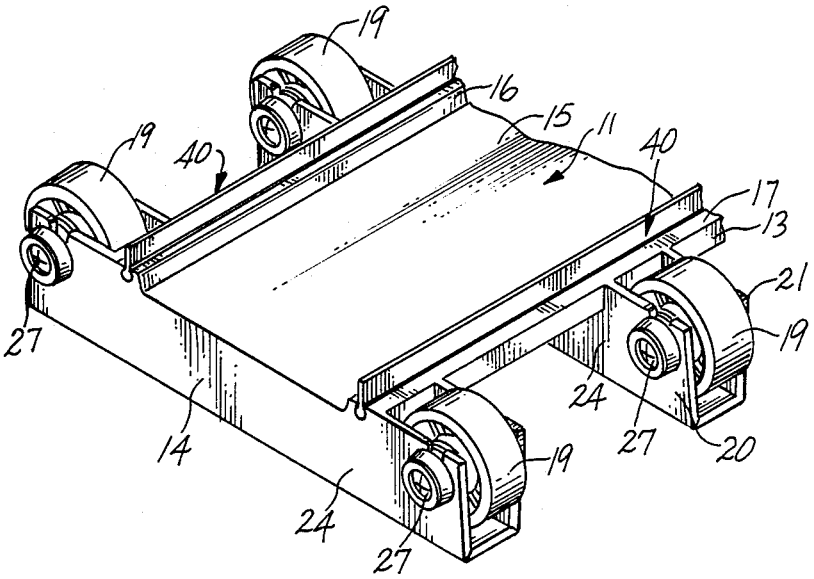
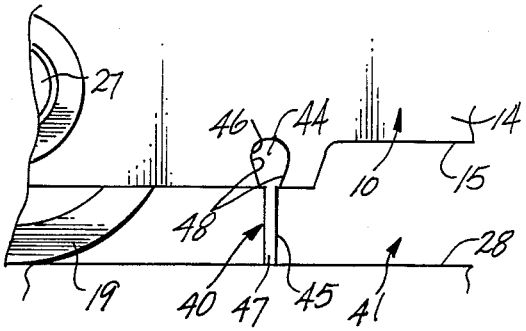
Fig. 4

WHEELED POOL VACUUM HEAD WITH VACUUM ENHANCING SEAL

FIELD OF THE INVENTION

This invention pertains to vacuum cleaner heads for cleaning submerged surfaces of swimming pools, spas, and the like. More particularly, it pertains to such a vacuum head equipped with seals which enhance the cleaning effect by directing water flow in the space between the head and a surface supporting the head in an improved manner.

BACKGROUND OF THE INVENTION

Wheeled vacuum cleaner heads for use in cleaning sediments and particulate matter from the submerged surfaces of swimming pools, spas and the like have been known for several decades and are now quite well known. Such devices first appeared as rigid articles having wheels for supporting an elongate platform-like cleaner body a selected distance above a pool surface to be cleaned. Those early cleaner heads, like those commonly used today, defined a hole through a central part of the body into a short upstanding tube which was configured to snugly receive and retain, usually about the outer surface of the tube, an end of a water suction hose. The other end of the hose was connected, directly or indirectly, to the suction port of a pump forming part of a circulation system for circulating water from the pool, through a filter, and a back to the pool. Such early cleaners, like those commonly used today, also included a mechanism for connecting to the cleaner body, adjacent the upstanding tube, a lower end of a pole usable by a person standing outside the pool adjacent its rim to maneuver the cleaner head as desired about on the submerged pool surface. Water flowing from the pool into the space between the cleaner head and the pool surface and into the hole in the body entrained in it sediment and particulate matter and carried it up through the suction hose for removal from the flowing water by the pool filter.

The early forms of wheeled pool vacuum cleaner heads were rigid. In about 1966, a flexible vacuum head according to U.S. Pat. No. 3,273,188 became commercially available and was followed by other forms of flexible heads. Flexible vacuum heads have gained wide, if not predominant, acceptance for several reasons, notably their ability to bend along their length to conform to curved portions of the submerged surfaces of swimming pools and spas. However, in one important respect, the flexible wheeled vacuum heads were like their rigid ancestors; they supported the cleaner head body in spaced relation to the surface being cleaned so that ingress of water into the space between the head and the pool surface occurred at all points around the perimeter of the space. In these rigid and flexible heads, some parts of the space perimeter were closer to the suction port of the head than were other parts of the space's perimeter, and so the velocity of water flow through those former parts of the perimeter and to the suction port was greater than the flow velocity of water through the other parts of the perimeter. The result was a velocity gradient in the water flow flowing in the space between the head and the pool surface. The cleaning action of such water flow was greatest where the flow velocity was greatest. This means that the cleaning efficiency of the head was greatest where the distance from the suction port to the perimeter of the head was shortest, and decreased rapidly as that distance increased to other parts of the head. In other words, the known rigid and flexible vacuum heads very definitely do not have uniform cleaning efficiency over their area.

The variation in cleaning efficiency of pool vacuum heads over their areas heretofore has been recognized and addressed in a nominal way. Shallow ribs have been formed in the undersides of various cleaner heads in various ways and arrangements in an effort to better direct the flow of water to the suction port of a head after it has entered at all places around its perimeter into the space between the head and the pool surface. The improvements provided by such ribs have been relatively small.

Therefore, the present state of wheeled vacuum heads for swimming pools is that they have greatest cleaning effect at their mid-length where the suction port to the suction hose opens to the underwise of the head body, and the cleaning effect decreases with distance along the heads on either side of the suction ports. The same conditions exist in the cleaning heads of suction-type automatic pool cleaners which move over pool floors at random in response to hydraulic forces applied to them.

A need exists for a wheeled vacuum cleaner head, useful to clean submerged surfaces of swimming pools and the like, in which the cleaning action of the head is substantially uniform along the length of the head and is not concentrated in the portion of the head closest to the suction port.

It is also known to manufacture and to market very long flexible wheeled swimming pool vacuum heads which have plural, usually two, suction ports through their bodies. These devices are marketed principally to professional pool cleaners and technicians whose economic objective is to clean as many pools per day as possible. Such long heads include a manifold tube connected between the several suction ports defined by the head and to which a single suction hose is connected in use for applying suction via the several suction ports to the space between the head and a surface being cleaned. In all other material respects, these long heads are like those described above. Examples of these long heads are found in the Rainbow Plastics Model 207 and Model 215 vacuum heads. Such long vacuum heads also present the need identified above.

SUMMARY OF THE INVENTION

This invention addresses the need identified above and provides a vacuum cleaner head for swimming pools and the like in which the cleaning effect of the head is substantially the same at all locations along the length of the head. A principal benefit is that pool cleaning operations can be performed more effectively by a cleaner head of this invention than can be achieved by a comparably sized cleaner head of conventional definition. This invention makes it possible to clean a pool faster and better than heretofore possible. The invention makes possible long vacuum heads having substantially uniform cleaning effect at all points along the heads; this benefit is of special value to professional pool technicians and cleaners. The invention is applicable to rigid and to flexible wheeled cleaning heads.

Generally speaking, this invention concerns a flexible vacuum head for use in cleaning the submerged surface of swimming pools and the like. The head includes an elongate unitary flexible body which has a substantially flat bottom surface when the body is disposed on a flat supporting surface. The body also has lengthwise front and rear edges spaced along a width of the body. The bottom surface of the body extends continuously without interruption between opposite ends of the body, which ends are spaced along the length of the body. The body is defined for flexing along a line in a lengthwise direction transverse to its width but not significantly along a line in a widthwise direction transverse to its length. A plurality of wheels are carried by the body forwardly of the front and rearwardly of the rear edges of the body for supporting the body bottom surface a selected distance above a support surface in substantially parallel realtion of the body bottom surface to the support surface. Suction port means are formed through the body substantially centrally of the length and width of the body. The suction port means includes means carried on an upper surface of the body for connecting a pool water suction line to the port means. Flexible liquid flow seal means are carried by the body and extend essentially the selected distance below the body bottom surface for close, substantially sealing coopertion with a support surface engaged by the wheels. The seal means are present along substantially the entire lengthwise extent of the body adjacent the front and rear edges of the body for defining, between the support surface and the body, an elongated chamber which is essentially closed along its sides and its top. The chamber has the suction port opening to it and is open at its ends. The chamber is of substantially constant transverse area and configuration along its length both at and between its open ends. In use of the vacuum head, the flow of water into the chamber is at least predominately through the open ends of the chamber and thence at substantially constant velocity along the chamber to the port means.

DESCRIPTION OF THE ACCOMPANYING DRAWINGS

The above-mentioned and other features of this invention are more fully set forth in the following detailed description of the presently preferred and other embodiments of the invention, which description is presented with reference to the accompanying drawings, wherein:

FIG. 2 is a fragmentary perspective view of an end portion of the vaccum head shown in FIG. 1, the head being seen upside down in FIG. 2;

FIG. 4 is a fragmentary enlarged end view of the structure indicated in circle 4 in FIG. 3;

DETAILED DESCRIPTION OF THE ILLUSTRATED EMBODIMENTS

Figure 1:
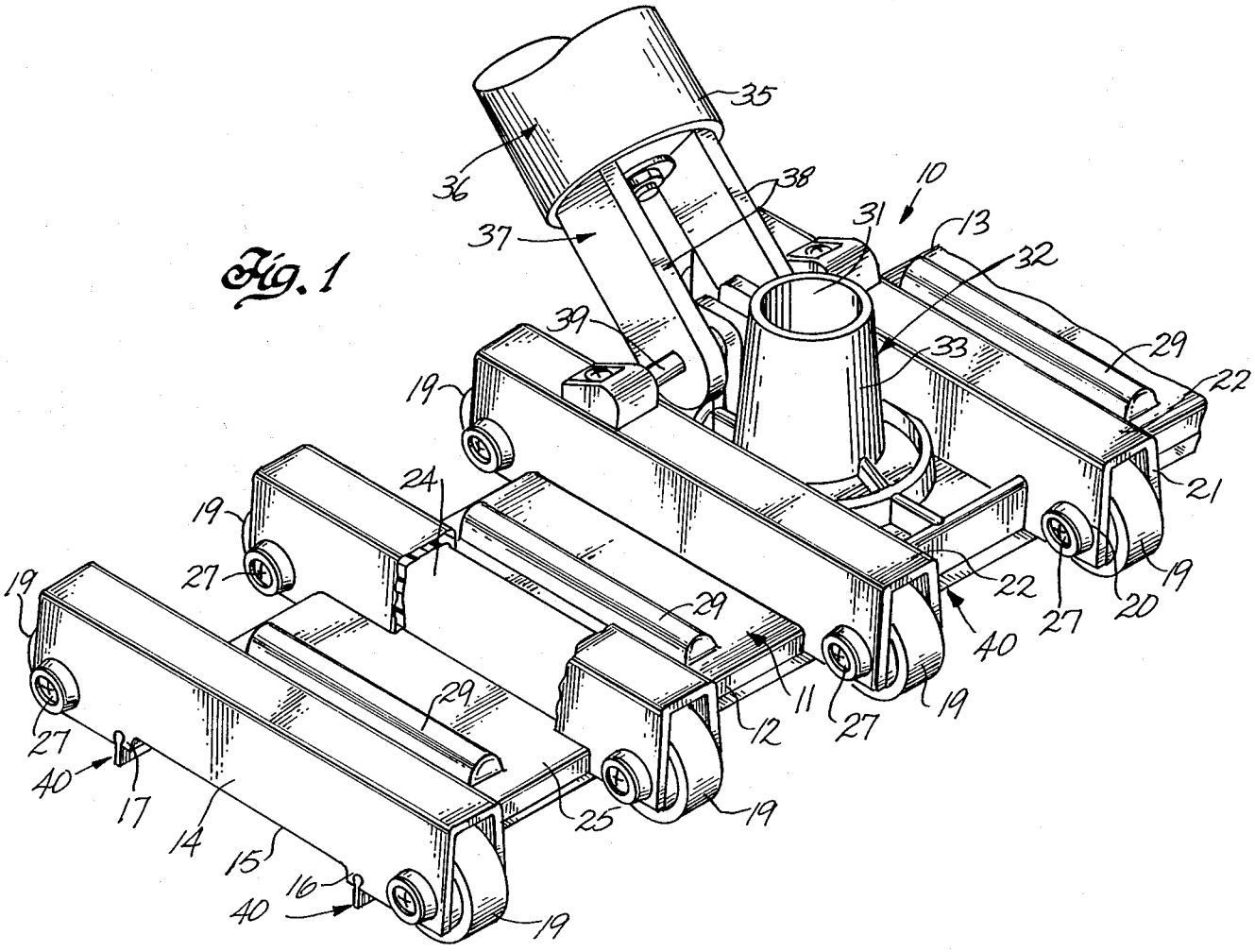
FIG. 1 is a perspective view of a flexible vacuum head and shows the presently preferred embodiment of the invention.
Figure 3:
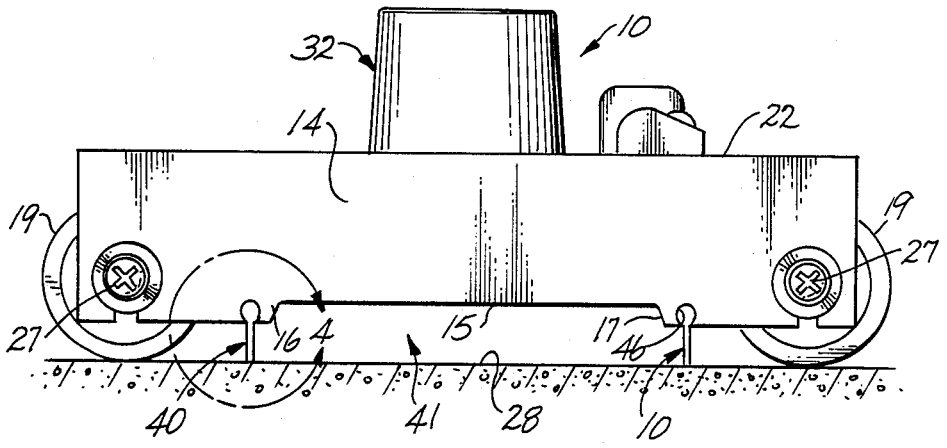
FIG. 3 is an end view of the vacuum head shown in FIG. 1.

FIGS. 1 through 4 show a flexible vacuum head 10 which comprises an elongate, generally flat body 11 having preferably parallel front and rear edges 12 and 13 which extend along the length of the body between opposite ends 14 of the body. Only one of body ends 14 is shown in FIGS. 1–4, it being understood that the head is symmetrical about a line across its width at the mid-length of the body; see FIG. 7 pertinent to cleaner head 100. The body has a substantially smooth bottom surface 15 (see FIG. 2) disposed between forward and rear edge ribs 16 and 17 which extend a selected distance downwardly below bottom surface 15 along the front and rear edges of the body. Ribs 16 and 17 extend from end to end of the body, as does bottom surface 15. The distance along the body between its opposite ends 14 defines the length of the body, and the distance across the body between its front and rear edges defines the width of the body.

The body of vacuum head 10 is defined, preferably by injection molding, of a flexible material which preferably is low density polyethylene. The basic geometry of body 11 is that of a flat rectangular platform having a substantially uniform thicknesses over its length between its opposite ends between front and rear ribs 16 and 17; other features of the body are defined on this platform. A plurality of supporting wheels 19 are mounted to the body at spaced locations along its length both forwardly of front edge 12 and rearwardly of rear edge 13. In the presently preferred embodiment of the invention represented by head 10, there are 12 wheels 19 carried by the body; the number of wheels provided in a flexible vacuum head will vary with the length of the head. The wheels preferably are grouped in pairs comprising a front wheel and a rear wheel; the wheels in each pair preferably are in a common plane disposed perpendicular to the basic plane of the body and the length of the body and parallel to the width of the body. Each wheel is carried between forward and rear extensions of the side walls 20 and 21 of a weight housing 22 within which a lead weight 24 is disposed. Each weight 24 is encased by its corresponding housing 22 and lies in the housing essentially on top of an upper surface 25 of the body and extends across the width of the body substantially between the front and rear edges of the body. There are six weights 24 in head 10; the number of weights provided will vary with the length of the head. The cleaner head preferably is molded of a material, such as low density polyethylene, which has a density less than 1.0. The weights are present in the head to impart to the head an overall density which is substantially greater than 1.0 so that the head has substantial negative buoyancy adequate to cause the head, when immersed in a swimming pool, to bear relatively forcefully against the pool floor.

Each of wheels 19 is carried on an axle 27 which extends between the relevant extensions of weight housing side walls 20 and 21. The axles are located forwardly of body front edge 12 and rearwardly of body rear edge 13. The axles preferably are disposed in an adjustable manner parallel to the body edges at selected positions in the weight housing wall extensions, such positions being selected in combination with the diameter of wheels 19 so that body bottom surface 15 is disposed a selected distance above a head support surface 28, such as the floor of a swimming pool or spa, when the head is placed upon such supporting surface. That is, in the presently preferred form of this invention, the mounting of each of wheels 19 to the head body is via axles 27 which have adjustable positions in the weight housing extensions. The positions of axles 27 in the weight housing entensions are vertically adjustable so that the axles can be moved to establish the desired relation of seals 40 to support surface 28 during use of head 10 for the reasons described below. The wheel axle positions preferably are adjusted to cause head bottom surface 15 to be maintained in its parallel relation to a support surface 28 either at a selected distance above the support surface or within a relatively narrow range of positions closer to the support surface than the selected distance.

Figure 7:
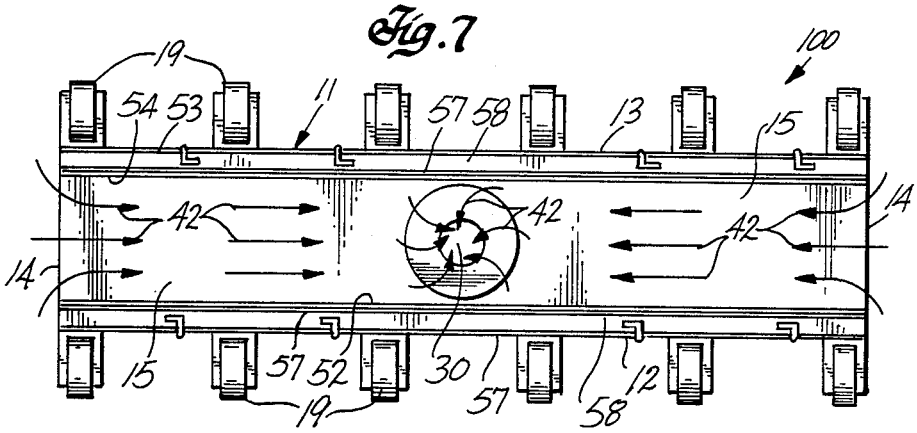
FIG. 7 is a view of the under side of a vacuum head according to this invention showing the pattern of water flow into the cleaning chamber beneath the head and into the suction port.

As shown in FIG. 7, a suction opening 30 is formed through the body of a vacuum cleaner head according to this invention. Preferably the suction opening is located centrally of the length and width of the head. Opening 30 is defined at the lower end of a tubular passage 31 which extends through the head and for a selected distance upwardly above the head. The passage is defined by the inner diameter of a tubular projection 32 which is carried by the upper surface of the body above the suction opening. The projection has an outer surface 33 which is that of a shallowly tapering upright truncated cone. Projection 32 thus defines a connection fitting via which the cleaner head can be connected to the lower end of a water suction hose. The connection of the hose (not shown) to the vacuum head is accomplished by force-fitting the lower end of the hose downwardly onto the conical outer surface of projection 32. During use of cleaner head 10, the other end of the suction hose typically is force-fitted into the suction port of a swimming pool or spa skimmer. The suction port of the skimmer is connected by suitable piping to the suction port of a pool or skimmer circulating pump which is a component of a water circulation system for the pool or spa. In a typical pool or spa circulation system, the circulating pump discharges water to a filter, from which water flows back to the swimming pool or spa in a known manner.

The suction connection fitting defined by projection 32 is located on the upper side of cleaner head 10 between the two weight housings 22 which lie closest to the midlenght of the head. Transverse stiffening means are incorporated into body 11 between the remaining weight housings of the cleaner head. The transverse stiffening means preferably are ribs 29 which project upwardly from the upper surface 25 of body 11 centrally of the intervals between the weight housings laterally on either side of projection 32.

Cleaner head 10 is a manually operable pool or spa cleaning device. Accordingly, in use it is connected to the lower end 35 of an elongate operating pole 36 via a pole coupling 37. The operating pole is releasably connectable to coupling 37, whereas the coupling is captive to the cleaner head. The coupling includes a pair of parallel coupling arms 38 which extend toward the head from that portion of the coupling with which the pole is connectable. The arms have journaling engagement with an axle 39 which is suitably secured to the structure of head 10. Axle 39 is disposed parallel to the length of head 10 adjacent to suction connection 32 and adjacect the rear edge 13 of the head, preferably by being mounted in a secure manner to the upper portions of the weight housings on either side of the suction connection.

Weights 24, housings 22 and stiffening means 29 are all disposed across the width of the cleaner head body at space locations along the length of the body. These features of the head cooperate to render the head stiff across its width, yet flexible to bending along its length. Accordingly, head 10 is a flexible vacuum head which can bend to conform to the curvature of the submerged surfaces of a swimming pool, as where the pool floor and side walls intersect or where the floor may curve in a transition between a shallow and a deep portion of the pool.

The precise arrangements used in a flexible vacuum head according to this invention to provide transverse stiffness and longitudinal flexibility of an inherently flexible body are aspects of the flexible head which are important in function, but are subject to considerable variation as to how that function is achived. For example, it is within the scope of the invention that the fully enclosed weights 24 and ribs 29 can be replaced by a plurality of ribs disposed in an upstanding manner on the upper surface of the platform-like body in spaced planes perpendicular to the length and bottom surface of the body. Some of such ribs can be extended forwardly and rearwardly of the body to provide structures akin to walls 20 and 21 of weight housings 22 and by wheel axles 27 can be mounted to the head. Lead weight can be mechanically affixed, as by bolting, to the body transverely of the body between selected adjacent pairs of such ribs.

Similarly, the precise arrangements by which an operating pole 36 can be connected to a vacuum head is also a matter which is capable of substantial variation within the scope of this invention.

Moreover, as will be apparent from the following descriptions, the improvements provided by the present invention can be incorporated in a rigid cleaner head fabricated of metal or a rigid synthetic resin.

One major difference between vacuum head 10 and swimming pool vacuum heads existing before the advent of this vention is the presence in head 10 of sealing members 40 which depend from the underneath portion of the head adjacent to the forward and rear boundaries of head bottom surface 15 along the entire length of the head between its opposite ends 14. Another difference between head 15 and vacuum heads, whether rigid or flexible, exsisting before the advent of this invention is that head bottom surface 15 extends to the opposite ends 14 of the head and its not bounded at the ends of the head by a wall or the like in the manner in which surface 15 is bounded along its front and rear extents by edge ribs 16 and 17. It is thus seen from FIGS. 3 and 4, for example, that when vacuum cleaner head 10 is in use and is supported by wheels 19 on supporting surface 28, the lower extents of the seal members 40 cooperate closely with surface 28. Such cooperation provides side walls of an elongate chamber 41 which has a top defined by the bottom surface 15 of the vacuum head and a bottom surface defined by support surface 28. This chamber is open at its opposite ends which correspond to the opposite ends 14 of the head; the chamber is otherwise closed or substantially closed along its sides. It is to this chamber 41 that suction port 30 communicates. Thus, when the vacuum head is in use and a suction hose is connected to projection 32 of the head, water can enter into chamber 41 preferably only through the ends of the chamber to flow from the ends toward the central suction port 30 (see FIG. 7). Because the chamber 41 preferably is of substantially constant cross-sectional area along its entire length between its open ends and the port, the velocity of water flow along the chamber is substantially constant and substantially uniform across the width of the chamber. Because the area through which the water can enter into and flow the chamber is a limited area, the flow velocity of water along the length of the chamber is a relatively high velocity.

It is seen, therefore, that, as the vacuum head is moved back and forth by a user in directions transverse to the length of the head, the portions of surface 28 over which the head moves are subjected to substantial scouring action by the water flowing through the chamber. This water flow very effectively cleans that surface of finely divided sediments and small particulate contaminants which are swept along the chamber into the suction port. Any sediments and particulate matter entering into the suction port of the vacuum head are carried by the suction hose into the swimming pool or spa circulation system to be removed from that water flow by the filter present in that circulation system before that water is then returned to the pool or spa. If movement of the vacuum head across the pool floor causes sediments and particulate matter to build up along the edges of the seal members outside chamber 41, that situation can be dealt with by merely briefly raising the vacuum head from the pool floor and positioning it in engagment with the pool floor over the ridge accumulated sediments so that the water flow along the length of the chamber then becomes effective to sweep those deposits into the suction port. It has been found, through use of developmental prototypes of vacuum heads according to this invention, that the presence of the water flow patterns represented by arrows 42 in FIG. 7 provides a substantial improvement in the ability of a vacuum cleaner head to rapidly, efficiently and effectively clean a swimming pool or spa, and particularly on pools and spas having low available suction levels. A pool vacuum cleaner head according to this invention cleans a pool much better than has heretofore been possible with previously existing wheeled vacuum cleaner heads.

Front and rear edge ribs 16 and 17 of cleaner head 10 provide mountings for seal members 40. As shown best in FIG. 4, each seal member preferably has a constant cross-sectional configuration along its length. That cross-sectional configuration is composed of a base or mounting portion 44 and a blade portion 45. The mounting portion of seal member 40 has a non-round cross-sectional configuration and is received in a mating recess 46 formed in the corresponding body edge rib. That is, the cross-sectional configuration of seal member mounting portion 44 and the contour of recess 46 are cooperatively defined so that the mounting end of the seal member can be placed into the recess in an appropriate manner, so that the mounting end of the seal member and the recess cooperate to secure the seal member from rotation relative to the vacuum head body, and so that, depending upon the amount of suction available to the head at suction port 30, the blade portion 45 of the seal member extends to its lower ends 47 in a direction which is substantially perpendicular to body bottom surface 15. The distance by which the blade portion of the seal member extends below the underside of the cleaner is coordinated with the diameter of wheels 19 and the positions of their axes of rotation in the cleaner head, so that the lower ends 47 of the seal members and the lowermost extents of the wheels 19 lie in a common plane when the cleaner head is placed upon a flat supporting surface, as when the available suction level is low, or so that the lower ends of the seal members lie a selected distance above the supporting surface, as when available suction levels are high. In this way, the lower end of each seal member either directly contacts a supporting surface on which the cleaner head is placed or is spaced a very slight distance above such surface. As a result, chamber 41 is sealed, or esentially sealed along its longitudinal boundaries so that no significant quantities of water adequate to adversely affect the cleaning efficiency of the head can enter the chamber along its sides, and so that all, or essentiallly all, of the water which enters into chamber 41 enters at its open ends as described above.

Seal member 40, as shown in FIG. 4, is the presently preferred form of seal member according to this invention. The presently preferred cross-sectional configuration of the mounting portion of that seal member is semi-circular at its extent opposite from blade 45, and has converging flat portions adjacent the blade which cooperate intimately with correspondingly disposed flat portions 48 of the surface of recess 46. Seal member 40 preferably is an extrusion of a flexible resilient material such as rubber or suitable synthetic resin. It is within the scope of this invention, however, that the seal member may be defined by a coextrusion process which causes the blade portion of the seal member to be softer, more flexible, and more resilient than the mounting portion of the seal member which can be defined by a stiffer material. It is desired, however, that the seal member be relatively flexible along its length, so that it can bend in the plane of the blade portion and thereby not impair the ability of cleaner head body 11 to bend its length to conform to curvatures of support surface 28 during use of the cleaner head, and so that the seal member itself conforms in the desired way to the curvatures of the support surface during use of the cleaner head.

The seal member can be engaged in recess 46 by sliding the mounting portion of the seal member into recess 46 from one end of the recess. A lubricant on the recess surface or the exterior of the seal member mounting portion may be used to facilitate this insertion process.

If seal member 40 is initially defined so that, as installed vacuum head 10, its lower end 47 lies in the same plane as the lowermost extents of wheels 19 when the wheels are supported on a flat plane, the lower end of the seal member will contact that plane. If the support surface for the vacuum head is a submerged surface of the swimming pool, the free end of the blade portion cannot wear, as by abrading against the pool surface, any faster than the wheels wear and reduce in diameter. It is seen, therefore, that, as the wheels wear over time during use of the vacuum head so as to reduce diameter and thereby reduce the height of chamber 41, the seal members will also wear at the same rate. If the axles of wheels 19 are made vertically adjustable in their supports on the vacuum head, the wheels may be lowered as they wear.

It has been found, through experiments conducted with prototype vacuum heads according to this invention, that it is desirable to provide head support wheels which are positionally adjustable in the head as described above. It is the substantial improvement provided by seals 40. e.g., which makes it desirable that the wheels be positionally adjustable so that the spacing of seals 40 from support surface 28 can be selected within a range extending from actual contact of the seals with the surface to a position where the seals are spaced a desired amount from the surface. It has been found that when the seals actually or very nearly contact the pool surface and the vacuum head is used in a pool which, for a number of possible reasons, has a high level of suction available at suction port 30 , the effect of the seals is so pronounced that the head, in effect, sticks to the pool surface and cannot be moved readily across the pool surface. In such a situation, the wheels are adjusted on the head to raise the seals a desired distance above the pool surface so that the head intentionally leaks water into chamber 41 along its sides, or along selected portions of its sides, sufficiently to prevent the sticking effect from being produced but insufficiently to meaningfully detract from the enhanced cleaning effects produced by the seals along the chamber sides. On the othe hand, if the head is used in a pool which provides low suction levels at suction port 30, the wheels can be adjusted so that the seals contact, or essentially contact, the pool surface along the sides of chamber 41, thereby eliminating leakage along the chamber sides and providing the maximum effects of the invention.

The level of suction available at suction port 30 can vary considerably from pool to pool. The amount of vacuum available at the suction port is dependent upon a number of factors. These factors include circulation pump type and size, the size and extent of the piping used in the circulation system outside the pool, the length of hose used to connect the head to the suction port in the pool, the nature and state of the filter in the pool circulation system, and the cleanliness of a skimmer basket which may be present in the connection between the head and the circulation pump. Accordingly, as a professional pool cleaner or pool service technician moves from pool to pool to clean the same, he may encounter some pools having good suction and others having relatively poor suction. If such a person does not have plural cleaner heads each adjusted for best balance between cleaning efficiency and a relevant available suction level, that person may fine it useful to adjust the wheel positions on head 10 for the situation provided by the pool to be cleaned at a given time.

Arrangements of cleaning chamber seal members different from seal members 40 are within the scope of this invention. For example, seal members 50 are useful with vacuum cleaner head 100 shown in FIG. 5. Cleaner head 100 can be identical to cleaner head 10 in terms of the structure of the head per se except in the specific ways illustrated in FIG. 5 which is a transverse cross-sectional elevation view taken through the head at one of the intervals between adjacent ones of weight enclosures 22. Instead of having single front and rear edge ribs as are found in head 10 for mounting of seal members 40, in head 100 there are inner and outer forward edge ribs 51 and 52, respectively, and inner and outer rear edge members 53 and 54, respectively; see also FIG. 8. Outer forward edge rib 51 is defined so that its outer surface is coincident with the front edge 12 of head 100. Inner forward edge rib 52 is spaced a selected distance inwardly of the outer forward edge rib and parallel to it and extends the same distance downwardly from body bottom surface 15. The inner and outer rear edge ribs 53 and 54 are disposed in a similar relation to each other adjacent to body rear edge 13.

Figure 5:
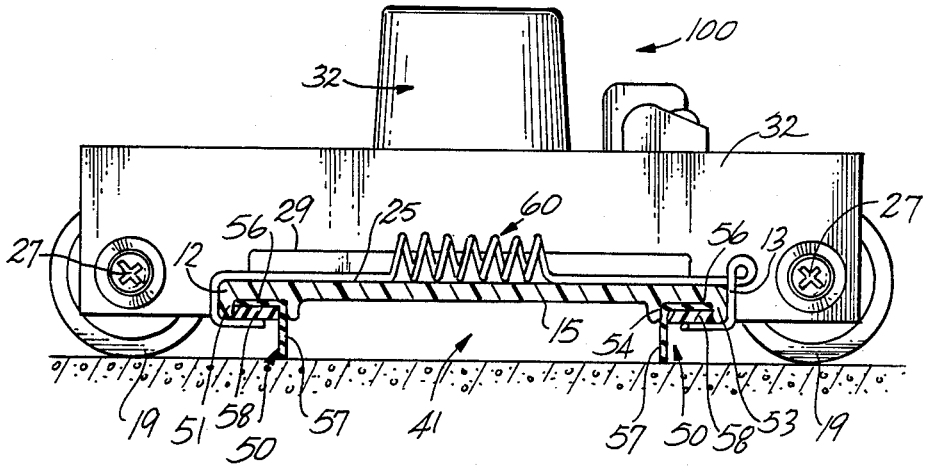
FIG. 5 is a cross-sectional elevation view of another swimming pool vacuum head according to this invention.
Figure 6:
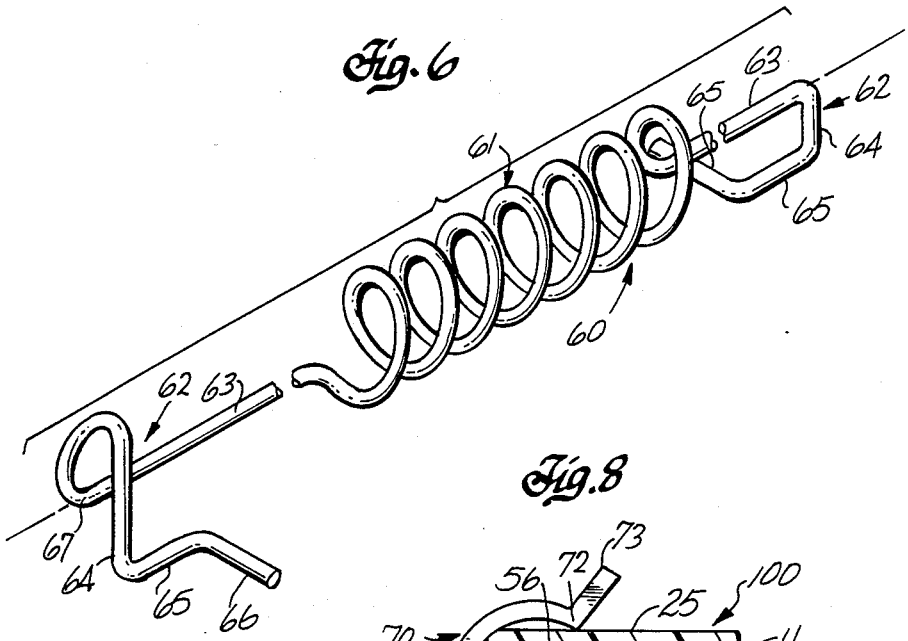
FIG. 6 is a fragmentary perspective view of a seal-member retainer spring useful in the embodiment of the invention shown in FIG. 5.
Figure 8:
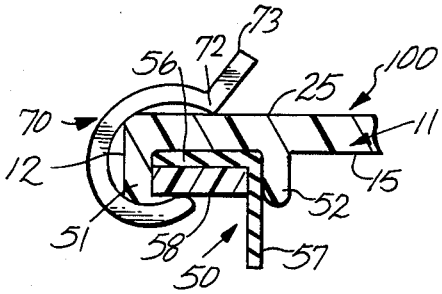
FIG. 8 is a fragmentary cross-sectional elevation view illustrating another retainer for securing the seal member shown in FIG. 5 in position in a vacuum head.

Seal members 50, useful with head 100, are of L-shaped configuration. Each such seal member has a mounting flange 56 and a blade flange 57 disposed at substantially right angles to each other. The mounting flange of seal member 50 has a width defined in combination with the thickness of its blade flange so that the mounting flange and the adjacent marginal portion of the blade flange can be disposed against head surface 15 between the inner and outer ribs of the forward and rear edge rib sets of head 100 as shown in FIGS. 5 and 8. After the mounting flange of the seal member has been so disposed in the space between the inner and outer rib members of the edge rib set, a backer strip 58 is disposed against the lower side of the seal member mounting flange along the length of the flange. The backer has its lower surface essentially coplanar with the lower extents of the adjacent ribs 51–52 or 53–54. The end configuration of a resilient seal member retainer 60, shown in fagmentary perspective view in FIG. 6, is then engaged with the backer and the adjacent structure of the head body in the manner shown in FIG. 5. The retainer applies retaining force to the backer sufficient to clamp the adjacent seal member mounting flange 56 securely between the backer and the head body so that the seal member blade flange 57 extends downwardly from adjacent the inner rib 52 or 54 as appropriate. The seal member is defined of a relatively flexible and resilient material such as rubber or a soft plastic.

As shown best in FIG. 6, retainer 60 preferably is formed from corrosion resistant spring wire to define a central tension spring 61 from which the wire of the retainer 60 extends in opposite directions substantially collinearly into end configurations 62. Each end configuration has a top run 63 which, upon connection of retainer 60 to head 100 in the manner shown in FIG. 5, lies against body top surface 25. Each end configuration also has a vertical run 64 and a bottom return run 65 which terminates in a lateral bend 66. The lateral bend 66 and the return run 65 are in a common plane which is perpendicular to the edge run 64. The bottom return run 65 is parallel to top run 63 in each end configuration. One of the end configurations or retainer 60 defines a loop 67 between the top run 63 and the edge run 64 thereof. The loop provides a feature of the retainer which can be grasped by hand or by a suitable tool to extend the central tension spring 61 of the retainer after the opposite end configuration has been engaged over an edge of the cleaner head body in the manner shown in FIG. 5. Preferably lateral bends 66 of the two end configurations extend in opposite directions from the adjacent bottom returns 65.

A different retainer 70 which can be used with seal members 50 and backer strips 58 is shown in FIG. 8. Retainer 70 preferably is provided by a length of preferably corrosion resistant spring wire bent into a shape generally resembling the major portion of a question mark. It is proportioned so that when engaged with a seal member backer 58 and swung into position over the adjacent edge of the vacuum head body, the end of the accurately curved portion of the retainer engages the backer closer to the adjacent edge 12 or 13 of the body than does the retainer engage body upper surface 25 via a knuckle 72 between the accurately curved portion of the retainer and a straight terminal portion 73. Terminal portion is provided so that retainer 70 can be manually engaged for placement on or removal from the body as needed.

Workers skilled in the art and technology pertinent to the cleaning of swimming pools, spas and the like, and in the design and manufacture of equipment for such cleaning purposes, will appreciate that the principles of this invention are applicable to many forms of wheeled vacuum cleaner heads for use in swimming pools. This is true whether or not the cleaning head is flexible or rigid, and whether or not the head is to be manually moved across the floor of a swimming pool or is one intended for use in an automatic pool cleaner where the forces causing the cleaner head to move across the pool are hydraulicly generated. The seal members provided in a wheeled swimming pool vacuum cleaner head by this invention preferably are mounted in the cleaning head in spaced parallel relation to each other to define the sidewalls of a cleaning chamber which has open opposite ends for flow of water into the chamber toward a suction port at about the midlength of the chamber. The function of the sealing members in a wheeled vacuum is to prevent leakage of water into the cleaning chamber along its sides and to restrict the flow of water into the chamber only through its open ends. Sealing members can be disposed other than in spaced parallel relation to each other depending upon the geometry of the cleaning head of interest. The invention can be used in cleaner heads having one or more suction ports through their bodies; the benefits of the invention are sufficiently great that the invention may reduce the need for multi-ported cleaner heads.

Also, workers skilled in the art to which this invention pertains will appreciate that sealing members having geometries and cross-sectional configurations and mounting arrangements different from those described above may be provided and used without departing from the scope of this invention. Such persons will also recognize that the structure and geometry of the vacuum cleaner head in areas other than that of the sealing members and their mountings can be varied with considerable latitude without departing from the scope of this invention. In essence, the principles of this invention can be used with many existing vacuum cleaner head subject to minor modifications of a head to provide the desired open ended cleaning chamber and the mounting of the sealing members of appropriate configuration. Accordingly, the preceding description, pertinent to a presently preferred and other embodiments of this invention, has been presented by way of example and does not constitute an exhaustive catalog of all structural arrangements and procedures embodying this invention. In that light, therefore, the appended claims are to be construed and interpreted as broadly as is fairly proper consistent with the preceding descriptions and the place which this invention occupies in the development of vacuum cleaner heads for swimming pools and the like.

What is claimed is:

1. A flexible vacuum head for use in cleaning the submerged surfaces of swimming pools and the like which includes:

an elongate unitary flexible body having a substantially flat bottom surface when the body is disposed on a flat supporting surface and lengthwise front and rear edges spaced along a width of the body, the body bottom surface extending continuously without interruption between opposite ends of the body spaced along the length of the body, the body being defined for flexing along a line in a lengthwise direction transverse to its width but not significantly along a line in a widthwise direction transverse to its length;

a plurality of wheels carried by the body forwardly of the front and rearwardly of the rear body edges for supporting the body bottom surface a selected distance above a support surface in substantially parallel relation of the body bottom surface to the support surface;

suction port through the body substantially centrally of the length and width thereof including means carried on an upper surface of the body for connecting a pool water suction line to the port means; and flexible liquid flow seal means carried by the body and extending essentially said selected distance below the body bottom surface for close, substantially sealing cooperation with a support surface engaged by the wheels, the seal means being present along substantially the entire lengthwise extent of the body adjacent the front and rear edges of the body for defining between the support surface and the body an elongate chamber which is essentially closed along its sides and top, to which the suction port means opens, and which is open at its ends, the chamber being of substantially constant transverse area and configuration along the length thereof at and between its open ends;

whereby in use of the vacuum head the flow of water into the chamber is at least predominantly through the open ends of the chamber and thence at substantially constant velocity along the chamber to the port means.

2. Apparatus according to claim 1 wherein the wheels are disposed to engage a support surface outside the chamber at spaced locations along the length of the body.

3. Apparatus according to claim 1 wherein each seal means comprises an elongate seal member having a mounting portion adapted to be engaged with the head body for mounting the seal member to the body and a blade portion disposed to extend from the body into said close relation with a support surface upon engagement of the mounting portion with the body, and wherein the seal member mounting portion is defined of a material different from and stiffer than that of the blade portion.

4. A vacuum head for use in cleaning the submerged surfaces of swimming pools and the like which includes:

an elongate body having a bottom surface and front and rear edges;

a plurality of wheels carried by the body for supporting the body bottom surface a selected distance above a support surface;

suction port means through the body including means for connecting a pool water suction line to the port means; and front and rear liquid flow seal means carried by the body and cooperating in close relation between the body and support surface engaged by the wheels, the seal means extending lengthwise along the body adjacent the front and rear edges of the body for defining between the support surface and the body a chamber to which the suction port means opens and which is open at its ends, but not significantly so along sides thereof define by the seal means;

each seal means comprising an elongate seal member having a mounting portion adapted to be engaged with the head body for mounting the seal member to the body and a blade portion disposed to extend from the body into said close relation with a support surface upon engagement of the mounting portion with the body; and seal mounting means comprising a pair of ribs disposed in spaced substantially parallel relation and extending along the length of the body adjacent a body edge, the ribs projecting from the body bottom surface, the seal member mounting portion being configured to extend between the ribs; and means engagable over the adjacent body edge and between the top and bottom of the body for clamping the seal member mounting portion against the body bottom surface between the ribs.

5. Apparatus according to claim 4 wherein the seal member is of substantially L-shaped cross-sectional configuration, one leg of the "L" comprising the blade portion and the other leg comprising the mounting portion.

* * * * *